US008197086B2

(12) United States Patent
Watanabe et al.

(10) Patent No.: US 8,197,086 B2
(45) Date of Patent: Jun. 12, 2012

(54) LIGHTING FIXTURE

(75) Inventors: Hiroaki Watanabe, Odawara (JP); Erika Takenaka, Yokohama (JP); Kozo Ogawa, Yokosuka (JP); Keiichi Shimizu, Yokohama (JP); Tatsuo Maruyama, Numazu (JP)

(73) Assignees: Toshiba Lighting & Technology Corporation, Kanagawa (JP); Kabushiki Kaisha Toshiba, Tokyo (JP)

( * ) Notice: Subject to any disclaimer, the term of this patent is extended or adjusted under 35 U.S.C. 154(b) by 284 days.

(21) Appl. No.: 12/623,906

(22) Filed: Nov. 23, 2009

(65) Prior Publication Data

US 2010/0128480 A1 May 27, 2010

(30) Foreign Application Priority Data

Nov. 24, 2008 (JP) ..... 2008-298888

(51) Int. Cl.
*F21V 29/00* (2006.01)

(52) U.S. Cl. ..... 362/218; 362/294; 362/373

(58) Field of Classification Search ..... 362/218, 362/219, 294, 346, 249.02, 249.06
See application file for complete search history.

(56) References Cited

U.S. PATENT DOCUMENTS

| | | | | |
|---|---|---|---|---|
| 2,007,489 | A | 7/1935 | Westberg | |
| 7,815,338 | B2 * | 10/2010 | Siemiet et al. | 362/218 |
| 2002/0125839 | A1 | 9/2002 | Yen | |
| 2006/0227558 | A1 | 10/2006 | Osawa | |
| 2008/0084693 | A1 | 4/2008 | Shimada | |
| 2008/0089071 | A1 | 4/2008 | Wang | |
| 2008/0246383 | A1 | 10/2008 | Chang | |

FOREIGN PATENT DOCUMENTS

| | | |
|---|---|---|
| DE | 202004003793 | 5/2004 |
| EP | 1772668 | 4/2007 |
| EP | 1950491 | 7/2008 |
| JP | 2005-79593 | 3/2005 |
| JP | 2008-140606 | 6/2008 |
| JP | 3146172 | 10/2008 |
| JP | 2009-037995 | 2/2009 |
| JP | 2009-54989 | 3/2009 |
| JP | 2009-212367 | 9/2009 |
| WO | WO2006/091538 | 8/2006 |

OTHER PUBLICATIONS

English Abstract of JP 2005-79593 published Mar. 24, 2005.
English Translation of JP 2005-79593 published Mar. 24, 2005.
English Abstract of JP 2009-212367 published Sep. 17, 2009.
English Translation of JP 2009-212367 published Sep. 17, 2009.
English Abstract of JP 2009-54989 published Mar. 12, 2009.

(Continued)

*Primary Examiner* — Thomas Sember
(74) *Attorney, Agent, or Firm* — DLA Piper LLP (US)

(57) ABSTRACT

A lighting fixture includes a light-emitting section composed of a plurality of semiconductor light-emitting devices arranged separated from one another on a planar substrate and a lighting control section configured to control lighting of the semiconductor light-emitting devices of the light-emitting section. The light-emitting section is attached at a front of a fixture main body, and a convection generation section configured to generate convection is provided at a back of the fixture main body. The convection generation section generates convection and promotes heat radiation. With the configuration, even if the lighting fixture is installed to abut on a ceiling surface, the effect of radiating heat generated by the semiconductor light-emitting devices can be ensured.

6 Claims, 2 Drawing Sheets

OTHER PUBLICATIONS

English Translation of JP 2009-54989 published Mar. 12, 2009.
U.S. Appl. No. 12/909,535 electronically captured on Feb. 7, 2011.
U.S. Appl. No. 12/973,992 electronically captured on Feb. 7, 2011.
Extended European Search Report issued in corresponding European Patent Application No. 09014512.9 on Feb. 15, 2010.
English Language Abstract of DE 202004003793, published May 13, 2004.
English Language Abstract of JP 2008-140606, published Jun. 19, 2008.
English Language Machine Translation of JP 2008-140606, published Jun. 19, 2008.
Extended European Search Report issued in EP 10001621.1 on Jun. 17, 2010.
U.S. Appl. No. 12/708,564 electronically captured on Nov. 15, 2010.
U.S. Appl. No. 12/788,348 electronically captured on Nov. 15, 2010.
English language Abstract of JP 2009-037995, published Feb. 19, 2009.
Machine English language translation of JP 2009-037995, published Feb. 19, 2009.
English language abstract of JP 3146172 published Oct. 15, 2008.
Machine English language translation of JP 3146172 published Oct. 15, 2008.

* cited by examiner

LIGHTING FIXTURE

This application is based upon and claims the benefit of priority from the prior Japanese Patent Applications No. 2008-298888, filed in Japan on Nov. 24, 2008; the entire contents of which are incorporated herein by reference.

BACKGROUND OF THE INVENTION

1. Field of the Invention

The present invention relates to a lighting fixture including a light-emitting section composed of a plurality of semiconductor light-emitting devices arranged on a substrate.

2. Description of Related Art

In a lighting fixture including a light-emitting section composed of a plurality of semiconductor light-emitting devices arranged on a substrate, a radiator configured to radiate heat generated by the semiconductor light-emitting devices is provided. Examples of a lighting fixture which uses LEDs as semiconductor light-emitting devices and is designed with heat radiation in mind include an LED lighting fixture which has good heat radiating effect to offer an extended useful life. Such an LED lighting fixture is disclosed in, for example, Japanese Utility Model No. 3,146,172 (hereinafter referred to as Document 1).

The LED lighting fixture described in Document 1 is composed of an aluminum extruded radiator base, an LED module, a condensing plate, a translucent cover, and electric plugs provided at two ends. The LED module is composed of a substrate which is fixed to the radiation base and a plurality of LED lights electrically connected to the substrate. The condensing plate is fixed on a bottom plate of the radiator base, and the condensing plate and the translucent cover fixedly fit into locking grooves, respectively, formed in the radiator base. The electric plugs are connected to the two ends, respectively, of the radiator base, and the substrate is electrically connected to the electric plugs. The LED lighting fixture is configured such that heat generated by the LED module is conducted to the radiator base of an aluminum extruded material and is rapidly radiated.

In Document 1, a main body of the lighting fixture is made of the aluminum extruded material, and the main body as a housing serving both as a radiator and a fixture main body has improved heat radiating effect. However, further improvement in heat radiating effect requires an increase in radiator size. Additionally, heightwise lengths of radiator fins of the radiator base of the aluminum extruded material are equal. Accordingly, if the radiator fins are directly attached to a ceiling surface, an airflow direction is limited, which may lead to restrictions on the heat radiating effect.

SUMMARY OF THE INVENTION

The present invention has as an object to provide a lighting fixture capable of improving the effect of radiating heat generated by semiconductor light-emitting devices.

A lighting fixture according to the present invention includes a light-emitting section composed of a plurality of semiconductor light-emitting devices arranged separated from one another on a planar substrate, a lighting control section configured to control lighting of the semiconductor light-emitting devices of the light-emitting section, a fixture main body in which the light-emitting section is attached at a front, and a convection generation section configured to generate convection at a back of the fixture main body.

The above and other objects, features and advantages of the invention will became more clearly understood from the following description referring to the accompanying drawings.

DETAILED DESCRIPTION OF EMBODIMENTS OF THE INVENTION

Figure 1:
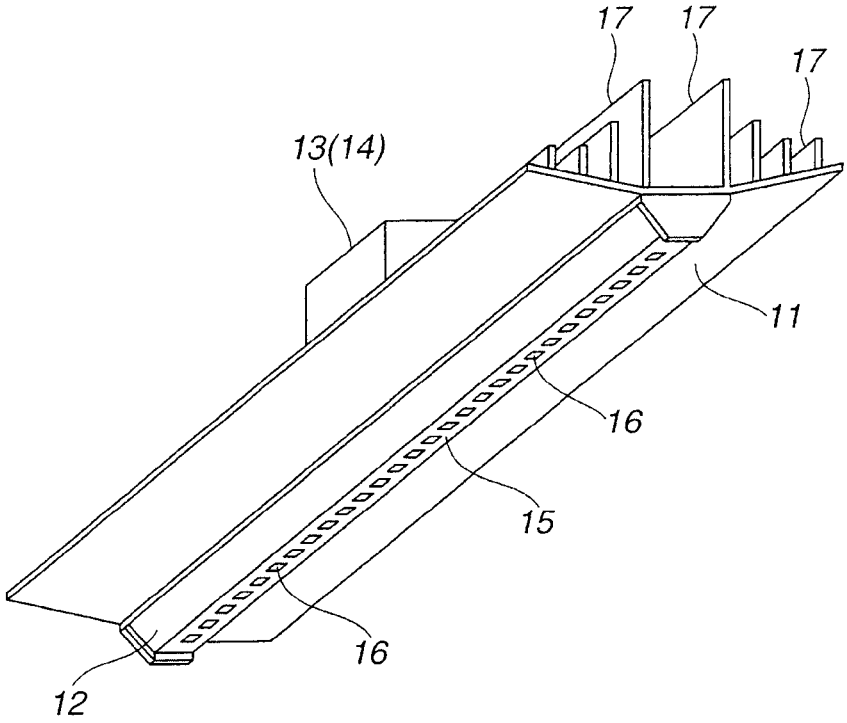
FIG. 1 is a perspective view of a lighting fixture according to an embodiment of the present invention.
Figure 2:
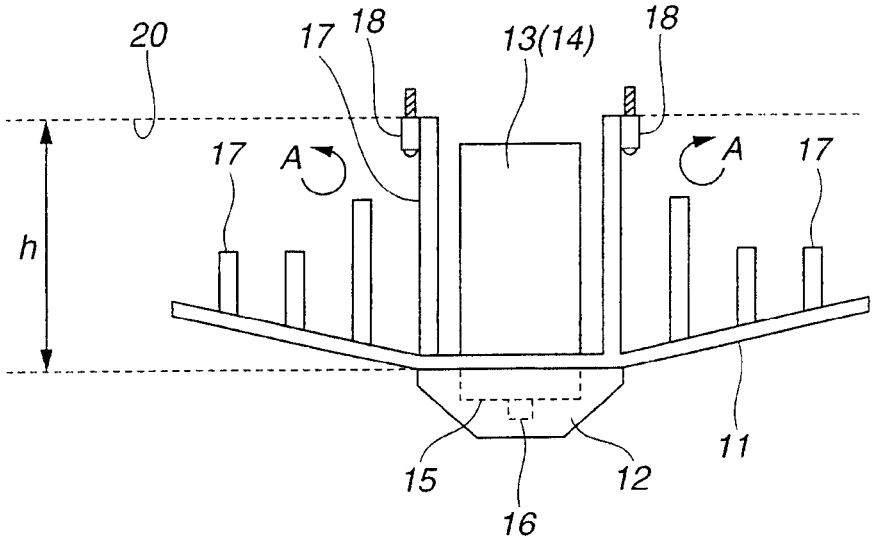
FIG. 2 is a plan view of the lighting fixture according to the embodiment of the present invention, as seen from one end of the lighting fixture.

An embodiment of the present invention will be described below with reference to the drawings. FIG. 1 is a perspective view of a lighting fixture according to the embodiment of the present invention, and FIG. 2 is a plan view of the lighting fixture as seen from each end of the lighting fixture.

A light-emitting section 12 is attached at a front of a fixture main body 11 while a lighting control section 13 and a power supply section 14 are attached at a back of the fixture main body 11. The light-emitting section 12 is formed to have a plurality of semiconductor light-emitting devices 16 arranged separated from one another on a planar substrate 15 and is attached such that the semiconductor light-emitting devices 16 are located at the front of the fixture main body 11. Power supplied from the power supply section 14 to the semiconductor light-emitting devices 16 of the light-emitting section 12 is adjusted by the lighting control section 13, and lighting of the semiconductor light-emitting devices 16 is controlled.

Examples of the semiconductor light-emitting device 16 include a light-emitting diode (LED), an organic light-emitting diode (OLED), and a light-emitting polymer (LEP).

A convection generation section configured to generate convection is provided at the back of the fixture main body 11. A plurality of fins 17 with different heights are provided as the convection generation section in FIGS. 1 and 2. The fins 17 are formed such that the heights of the fins 17 increase gradually from side edges of the fixture main body 11 toward a center.

Note that the convection generation section which generates convection at the back of the fixture main body 11 is intended to cause a temperature difference at the back of the fixture main body 11 by means of heat generated by the plurality of semiconductor light-emitting devices 16 arranged at the light-emitting section 12 and generate convection of air by means of the temperature difference.

As shown in FIG. 2, the highest fins 17 at the center of the fixture main body 11 have a height of h, and attachments 18 configured to attach the fixture main body 11 to a ceiling surface 20 (broken lines in FIG. 2) are provided at distal ends of the highest fins 17. The height h of the highest fins 17 corresponds to a distance from a lower radiator surface of the fixture main body 11 to the ceiling surface 20. The lower radiator surface of the fixture main body 11 is a surface with which a back surface of the substrate 15 of the light-emitting section 12 comes into contact when the substrate 15 is attached to the fixture main body 11. That is, the fixture main body 11 functions as a radiator, and the surface to which the substrate 15 is attached serves as a lower surface of the radiator.

Attachment of the fixture main body 11 to the ceiling surface 20 is performed using the attachments 18 at the distal ends of the highest fins 17 at the center of the fixture main body 11. The heights of the fins 17 decrease gradually from the center of the fixture main body 11 toward the side edges. Since the fins 17 at the side edges are more remote from the light-emitting section 12 than the fins 17 at the center, a thermal gradient (temperature difference) is generated between the center and the side edges at the back of the fixture main body 11, and a space is formed above the fin 17 at each side edge. For the reason, in the space formed above the fin 17 at each side edge, an airflow occurs toward the fin 17 at the center at a high temperature, and convection as indicated by an arrow A in FIG. 2 occurs. The convection promotes radiation of heat from the fin 17 at the center.

Figure 3:
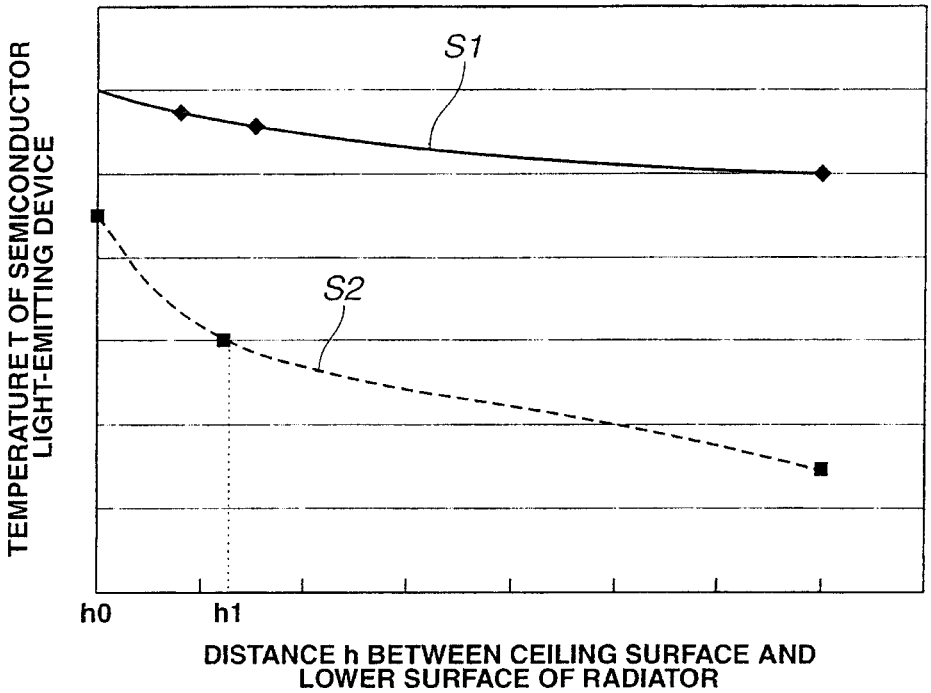
FIG. 3 is a graph of a temperature T of a semiconductor light-emitting device versus a distance h between a ceiling surface and a lower surface of a radiator.

FIG. 3 is a graph of a temperature T of the semiconductor light-emitting devices 16 versus the distance h between the ceiling surface 20 and the lower surface of the radiator. A curve S1 is a graph for a case where the fins 17 are not provided while a curve S2 is a graph for a case where the plurality of fins 17 are provided according to the embodiment of the present invention. That is, the curve S2 is a graph for a case where the fins 17, whose heights decrease gradually from the center of the fixture main body 11 toward the side edges, are provided.

As can be seen from FIG. 3, if the fins 17 are not provided, the temperature of the semiconductor light-emitting devices decreases approximately linearly with the distance h between the ceiling surface 20 and the lower surface of the radiator. On the other hand, if the plurality of fins 17 are provided according to the embodiment of the present invention, the temperature of the semiconductor light-emitting devices has the property of decreasing relatively sharply when the distance h between the ceiling surface 20 and the lower surface of the radiator is short, i.e., falls within the range of h0 to h1 and decreasing relatively slowly when the distance h is equal to or longer than h1. This is because the difference in height between the fins 17 causes a thermal gradient, and convection occurs to promote heat radiation.

As described above, since the heights of the fins 17 are configured to change gradually, even if the fixture main body 11 is close to the ceiling surface 20 at the center, effective heat radiation is performed. A size of the fixture main body 11 can thus be reduced. Additionally, since the lighting fixture is attached to the ceiling surface 20 by causing the distal ends of the highest fins to abut on the ceiling surface 20, the lighting fixture can be linearly attached to the ceiling surface 20 while ensuring heat radiating effect, and firm fixation is achieved.

As described above, according to the embodiment, a thermal gradient (temperature difference) is generated at the back of the fixture main body by means of heat generated by the plurality of semiconductor light-emitting devices in the convection generation section, and convection of air is generated by means of the temperature difference. Accordingly, the embodiment is advantageous in that cooling air occurs at the back of the fixture main body, and effective heat radiation can be performed.

Since the fin heights of the fins at the center of the fixture main body are largest, and the fin heights decrease gradually toward the side edges, convection occurs from the fin at each side edge at a low temperature toward the fin at the center at a high temperature. Even if the fins at the center are close to the ceiling surface, the heat radiating effect can advantageously be ensured.

In the above description, the fins 17 are formed such that the heights increase gradually from the side edges of the fixture main body 11 toward the center to generate convection by means of a thermal gradient. However, a conjugated radiator plate 18 may be arranged on a side surface of any of the plurality of fins 17, as shown in FIG. 4.

More specifically, the radiator plate 18 formed to be corrugated is fixed to a side surface of the fin 17 attached vertically to the fixture main body 11. The corrugated radiator plate 18 refers to a radiator plate formed to be corrugated in cross section. A clearance t is provided between a lower radiator surface 19 to which the substrate 15 of the light-emitting section 12 is attached and the corrugated radiator plate 18 to ensure a path for vertical convection.

With the configuration, better heat radiating effect can be achieved, and the fixture main body 11 of smaller size can be provided. That is, the radiator plate 18 formed to be corrugated increases a radiating area, and the clearance t ensured between the lower radiator surface 19 and the corrugated radiator plate 18 promotes generation of convection and improves radiation performance.

Figure 4:
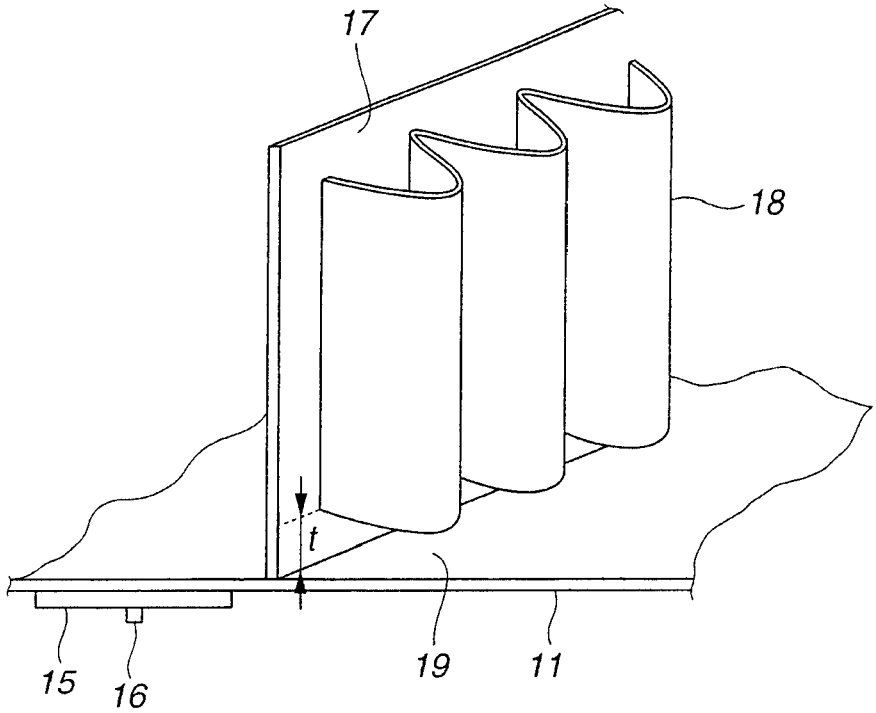
FIG. 4 is a perspective view showing another example of a radiator of the lighting fixture according to the embodiment of the present invention.

As described above, since the corrugated radiator plate is arranged on a side surface of any of the plurality of fins in the example in FIG. 4, better radiating effect can be achieved.

Having described the preferred embodiments of the invention referring to the accompanying drawings, it should be understood that the present invention is not limited to those precise embodiments and various changes and modifications thereof could be made by one skilled in the art without departing from the spirit or scope of the invention as defined in the appended claims.

What is claimed is:

1. A lighting fixture comprising:

a light-emitting section composed of a plurality of semiconductor light-emitting devices arranged separated from one another on a planar substrate;

a lighting control section configured to control lighting of the semiconductor light-emitting devices of the light-emitting section;

a fixture main body in which the light-emitting section is attached at a front; and a convection generation section configured to generate convection at a back of the fixture main body, wherein the convection generation section is composed of a plurality of fins provided at the back of the fixture main body; and the plurality of fins is configured such that fin heights of the fins increase toward the light-emitting section, wherein the lighting fixture further comprises an attachment provided at a distal end of a one of the fins which has a largest height and is configured to attach the fixture main body to a ceiling surface, wherein the convection generation section generates an airflow by means of a thermal gradient caused by a difference in height between the plurality of fins in a space between the back and the ceiling surface.

2. The lighting fixture comprising:

a light-emitting section composed of a plurality of semiconductor light-emitting devices arranged separated from one another on a planar substrate;

a lighting control section configured to control lighting of the semiconductor light-emitting devices of the light-emitting section;

a fixture main body in which the light-emitting section is attached at a front; and a convection generation section configured to generate convection at a back of the fixture main body, wherein the convection generation section is composed of a plurality of fins provided at the back of the fixture main body, and the plurality of fins is configured such that fin heights of the fins increase from side edges of the fixture main body toward a center, the lighting apparatus further comprising:

an attachment provided at a distal end of a one of the fins which has a largest height and is configured to attach the fixture main body to a ceiling surface; wherein the convection generation section generates an airflow by means of a thermal gradient caused by a difference in height between the plurality of fins in a space between the back and the ceiling surface.

3. The lighting fixture according to claim 2, wherein the light-emitting section is arranged at the center of the fixture main body.

4. The lighting fixture according to claim 2, wherein the lighting control section is provided at the center at the back of the fixture main body.

5. The lighting fixture according to claim 4, wherein the plurality of fins is configured such that the fin heights are symmetric about the lighting control section between the center and the side edges.

6. A lighting fixture, comprising:

a light-emitting section composed of a plurality of semiconductor light-emitting devices arranged separated from one another on a planar substrate;

a lighting control section configured to control lighting of the semiconductor light-emitting devices of the light-emitting section;

a fixture main body in which the light-emitting section is attached at a front;

a convection generation section configured to generate convection at a back of the fixture main body, the convection generation section including a plurality of fins; and a corrugated radiator plate arranged to be in contact with a side surface of at least one of the plurality of fins.

* * * * *